United States Patent [19]

Shinada et al.

[11] 4,060,749

[45] Nov. 29, 1977

[54] FLAT DISCHARGE DISPLAY PANEL HAVING POSITIVE COLUMN DISCHARGE AND AUXILIARY ANODE ELECTRODES

[75] Inventors: Shinichi Shinada, Kokubunji; Shigeo Mikoshiba, Tokyo, both of Japan

[73] Assignee: Hitachi, Ltd., Japan

[21] Appl. No.: 723,608

[22] Filed: Sept. 15, 1976

[30] Foreign Application Priority Data

Sept. 17, 1975 Japan ..... 50-111625
May 24, 1976 Japan ..... 51-59120

[51] Int. Cl.[2] ..... H01J 61/30; H01J 61/42; H01J 61/54; H01J 61/56

[52] U.S. Cl. ..... 313/484; 313/198; 313/217; 313/220; 315/58

[58] Field of Search ..... 313/484, 220, 188, 198, 313/217; 315/169 TV, 58

[56] References Cited

U.S. PATENT DOCUMENTS

| | | | |
|---|---|---|---|
| 2,967,965 | 1/1961 | Schwartz | 313/484 |
| 3,873,870 | 3/1975 | Fukushima et al. | 313/220 X |
| 3,886,395 | 5/1975 | Eukushima et al. | 313/220 X |
| 3,899,636 | 8/1975 | Chodil et al. | 313/220 X |

*Primary Examiner*—Palmer C. Demeo
*Attorney, Agent, or Firm*—Craig & Antonelli

[57] ABSTRACT

A flat discharge display panel has a transparent face plate made of an electrically insulating material, a base or substrate made of an electrically insulating material, an intermediate insulating plate interposed between the face plate and the base or substrate, a plurality of major discharge cells defined between the face plate and the intermediate insulating plate, a plurality of anodes each disposed in each of the major discharge cells, a plurality of auxiliary discharge cells defined between the intermediate insulating plate and the base or substrate, a plurality of cathodes each disposed in each of the auxiliary discharge cells, a plurality of of auxiliary anodes each disposed in each of the auxiliary discharge cells, the paired main and auxiliary discharge cells being intercommunicated through a through hole formed through the intermediate insulating plate, and the paired major and auxiliary discharge cells constituting a gas discharge cell, whereby the positive columns produced in each gas discharge cell as well as the discharge paths are in parallel with the face plate.

14 Claims, 22 Drawing Figures

FLAT DISCHARGE DISPLAY PANEL HAVING POSITIVE COLUMN DISCHARGE AND AUXILIARY ANODE ELECTRODES

BACKGROUND OF THE INVENTION

The present invention relates to generally a matrix type flat discharge display pannel for displaying alphanumerics, figures or images by utilizing DC gas discharges, and more particularly, a flat discharge display panel of the type described above and further having a memory function.

Various types of discharge display units utilizing DC gas discharges have been invented and demonstrated, and they are generally divided into two types, one utilizing negative glow and the other utilizing the positive column. Each discharge display unit is capable of producing a main discharge which is used for display purposes and an auxiliary discharge which facilitates the initiation of the main discharge. However, in the conventional discharge display units either or both of the main and auxiliary discharges are produced in the vertical direction relative to the transparent, insulating face plate of the discharge display panel so that an insulating plate having a large number of small holes which define the discharge spaces must be provided. This insulating plate must have a thickness sufficient for producing the negative glow or positive column. However, forming a large number of such small holes in a thick insulating plate presents a very serious problem when it is desired to enlarge the display area or to increase the number of discharge display units per unit area of a discharge display panel.

When a display in color is desired, a suitable phosphor is coated over the inner wall surfaces of the small holes, but since the small holes or discharge spaces are vertical to the face plate, only a small portion of light emitted can be used for display purposes. Thus, the conventional discharge display units have a common defect in that their luminosity, as well as light emitting efficiency, are very low.

There has been also devised and demonstrated a DC gas discharge display unit of the type wherein the plasma discharge constituting the main discharge is produced in parallel with the face plate. This discharge display unit has an advantage in that the small holes which are used as the main discharge spaces may be eliminated. Another advantage is its capability of producing highly luminous light. However, the auxiliary discharge is produced vertical to the face plate so that there still remains the problem of forming a large number of small holes vertical to the face plate which are used as the auxiliary discharge spaces. In addition, in this unit the cathode is interposed between the main and auxiliary anodes so that it is extremely difficult to add a memory function to the discharge units which are arrayed in matrix form.

SUMMARY OF THE INVENTION

One of the objects of the present invention is therefore to provide a flat discharge display panel capable of providing a memory function in a simple manner.

Another object of the present invention is to provide a flat discharge display panel whose display area may be enlarged or whose density of display units, that is, the number of discharge display units per unit area, may be increased in a simple manner.

A further object of the present invention is to provide a flat discharge display panel whose luminosity is high and which has high light emitting efficiency.

Briefly stated, to the above and other ends, the present invention provides a flat discharge display panel wherein, in each gas discharge cell or display unit, cathode is disposed between a main anode and an auxiliary anode which is perpendicular to the main anode so that the positive column produced between the main anode and cathode and the positive column produced between the auxiliary anode and the cathode may be parallel with each other, and wherein the cathode is connected to a resistor element so that a memory function may be provided.

BRIEF DESCRIPTION OF THE DRAWINGS

The same reference numerals are used to designate corresponding parts throughout the figures.

DESCRIPTION OF THE PREFERRED EMBODIMENTS

Figure 1:
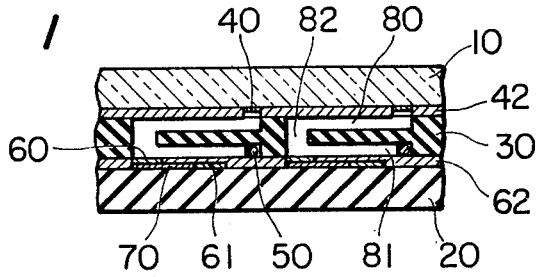
FIG. 1 is a sectional view of a first embodiment of the present invention.
Figure 2A:
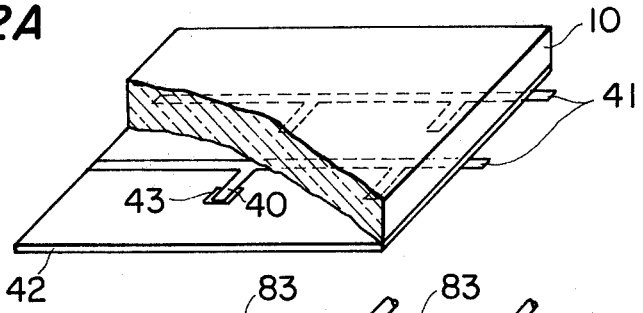
FIG. 2 is an exploded perspective view of a face plate, an intermediate insulating plate, and a base, respectively, of the embodiment of FIG. 1.
Figure 2B:
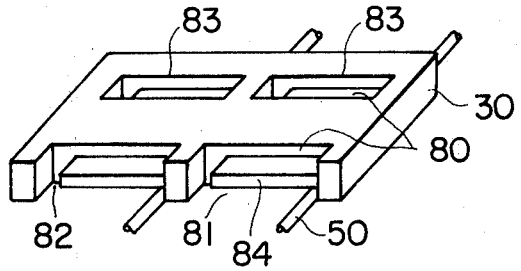
Figure 2C:
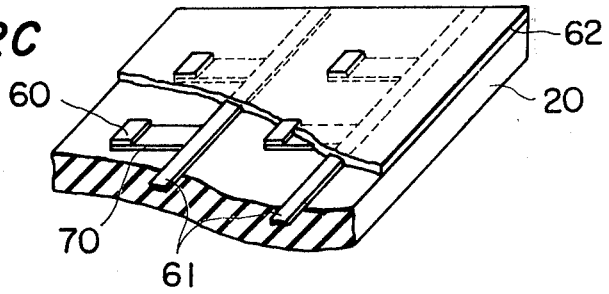

First Embodiment: FIGS. 1 and 2

In FIGS. 1 and 2 there is shown a first embodiment of a flat discharge display panel in accordance with the present invention comprising a transparent face plate 10 made of an electrically insulating material, such as soda glass, a substrate or base plate 20 made of an electrically insulating material, such as soda glass or ceramic, and a thin insulating plate 30 interposed between the face plate 10 and the substrate or base 20.

The face plate 10 includes a plurality of main anodes 40 and anode conductors 41 which are printed over the undersurface of the face plate 10. A dielectric layer 42 is formed over the undersurface of the face plate 10 in such a way that the main anodes 40 may be exposed through small holes 43 formed through the dielectric layer 42.

The intermediate insulating plate 30 includes a plurality of rectangular-shaped recesses or grooves 83 which are formed in the top main surface at the side of the face plate, for instance, by conventional photoetching techniques, each recesses having, for example, a width of 0.3 mm, a depth of 0.2 mm and a length of 1.5 mm. When the face plate 10 and the intermediate thin insulating plate 30 are assembled to each other, each recess or groove 83 defines a main discharge space or a display discharge space 80 into which the main anode 40 is exposed through the small hole 43 of the dielectric layer 42. In order to display in various colors, suitable phosphors may be coated over the sidewalls of each main discharge space 80. The phosphors may be coated over all or part of the surfaces of the sidewalls including the face plate 10.

A rectangular recess or groove 84 is formed in the undersurface of the intermediate insulating plate 30 in opposed relation with the main discharge space 80 so as to define an auxiliary discharge space 81 together with the base or substrate 20. A groove (not shown) is formed along one sidewall of each auxiliary discharge space 81 at right angles to the main anode conductors 41, and an auxiliary anode 50 of wire is inserted into this groove so that the main anodes 40 and the auxiliary anodes 50 form matrix shaped gas discharge cells. A slot or through hole 82 is formed on the other side of each auxiliary discharge space 81 to interconnect the main and auxiliary discharge spaces 80 and 81 so that the initiation of the main discharge may be facilitated by the diffusion of the charged particles produced by the auxiliary discharge.

Formed on the top main surface on the side of the intermediate thin insulating plate 30 of the base or substrate 20 are a plurality of resistors 70 for providing a memory function. A cathode 60 is formed at one end of each resistor 70 is opposed relation with the discharge cell by, for instance, sintering Ni (nickel paste), and the other end of the resistor 70 is connected to a cathode conductor 61, which may be formed by conventional thick or thin film printing techniques. A second dielectric layer 62 is interposed between the intermediate thin insulating plate 30 and the base or substrate 20 in such a way that the cathodes 60 may be exposed and the short-circuiting between the auxiliary anode 50 and the cathode conductor 61 may be prevented.

In addition, a suitable rare gas, such as He, Ne, Ar, Kr or Xe or Hg or a mixture thereof, is filled into the main and auxiliary discharge spaces including their passages 81 which are hermetically sealed. Thus, the flat discharge display panel is provided.

In the flat discharge display panel in accordance with the present invention, the display unit or element comprises the main and auxiliary discharge spaces which are formed in parallel with the face plate 10 so that high luminosity as well as high efficiency may be attained. Furthermore, in accordance with the present invention, the display discharge length may be increased and the positive column may be used for display purposes.

As with the case of fluorescent lamps, the high efficiency may be attained by the use of the positive column in the gas or glow discharge. In order to attain high efficiency, the length of the positive column must be increased sufficiently. According to the experiments conducted by the inventors, it was found that the optimum length of the positive column is between 0.5 and 3 mm when the depth of the main discharge space 80 is 0.2 mm. The optimum length is, of course, dependent upon the kind of gas used and its pressure. Another factor which determines the efficiency of the discharge display unit or element is the length of the main discharge space 80. The length must be in excess of the length of the positive column produced in the main discharge space 80.

With a sufficiently long discharge length between electrodes, starting from the cathode, there is the Aston or cathode dark space which is followed by the negative glow, the Faraday dark space and the positive column in the order named. Of these spaces, only the positive column is dependent upon the discharge length so that in order to produce the positive column, the discharge length must be longer than the length between the cathode and the Faraday dark space. The latter length in turn is dependent upon the kind of gas used and its pressure. In general, the higher the gas pressure, the shorter the discharge length becomes, and the discharge length is relatively shorter in the glow discharge in Ar, Xe or Hg than it is in He.

In order to produce the positive column of a sufficiently long length for display purposes irrespective of the kind of gas used and its pressure, the main discharge space 80 must have a length in excess of 0.5 mm. If the length is shorter than 0.5 mm, the positive column may be produced under the optimum conditions, but its length is too short, resulting in a decrease in efficiency. On the other hand, when the length of the main discharge space 80 is in excess of 3 mm, the efficiency may be increased but a voltage in excess of 1,000 V must be applied. When a voltage higher than 1,000 V is used, the circuitry design becomes extremely difficult because the breakdown voltage of the conventional transistors and the like to be used in below 1000 V. That is, there occurs a difficult problem as to how to drive the discharge display units. In addition, the thickness of the dielectric layers 42 and 62 must be increased accordingly so as to withstand a voltage higher than 1,000 V. More particularly, the thickness of the dielectric layer must be in excess of 100 microns, which is extremely difficult to attain by conventional thick or thin film techniques. Furthermore, the increase in length of the main discharge space 80 results in a decrease in resolution so that even when the display area is increased, a clear and distinct image cannot be obtained.

In view of the above, the optimum length of the main discharge space 80 is between 0.5 and 3 mm in practice.

The present invention may provide a memory function by interconnecting the resistor 70 between the cathode 60 and the cathode conductor 61. Let it be assumed that the auxiliary discharge is started and maintained when a voltage $V_S$ is impressed across the cathode conductor 61 and the auxiliary anode 50. When the voltage $V_A$ which is impressed between the cathode conductor 61 and the anode conductor 41 is gradually increased, the discharge is shifted from the auxiliary discharge space 81 to the main discharge space 80 at a certain voltage $V_{A(on)}$. When the voltage $V_A$ is gradually decreased, the discharge is shifted back into the auxiliary discharge space 81 at a voltage $V_{A(off)}$. The voltage difference between $V_{A(on)}$ and $V_{A(off)}$ provides a memory margin. Let the discharge break-down voltage in the main discharge space 80 be denoted by $V_{Abd}$, the discharge maintaining voltage by $V_{Am}$, the discharge breakdown voltage in the auxiliary discharge space $V_{Sbd}$ and the discharge maintaining voltage $V_{Sm}$. Then the voltage difference is given by $$V_{A(on)} - V_{A(off)} = (V_{Abd} - V_{Am}) + (V_{Sbd} - V_{Sm}).$$

Figure 9:
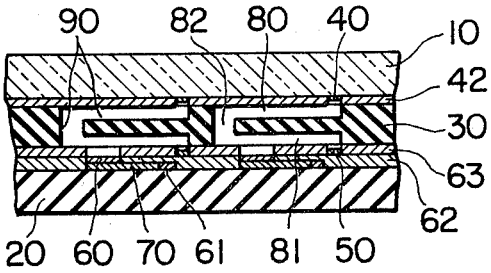
FIG. 9 is a sectional view of a fifth embodiment of the present invention.

Fifth Embodiment: FIG. 9

The fifth embodiment shown in FIG. 9 is substantially similar in construction to the fourth embodiment described above with reference to FIGS. 7 and 8 except that the thin insulating plate 31 is not used. The auxiliary anodes 50 are formed on the dielectric layer 62 by, for example, the conventional prining method, and an additional dielectric layer 63 is interposed between the dielectric layer 62 and the thin insulating plate 30 in such a way that the auxiliary anodes 50 may be exposed in the auxiliary discharge spaces 81.

In the fifth embodiment, it should be noted that the small hole or passage 85 is coated with a phosphor.

The fifth embodiment has an advantage in that it is very simple in construction yet capable of exhibiting the same features and advantages as those of the above embodiments.

Figure 10:
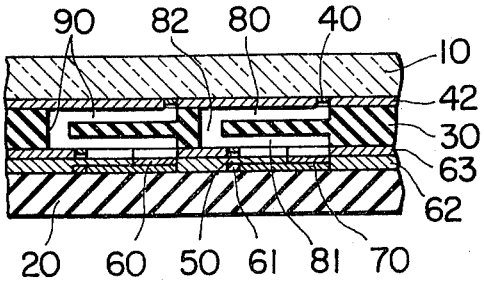
FIG. 10 is a sectional view of a sixth embodiment of the present invention.

Sixth Embodiment: FIG. 10

The sixth embodiment shown in FIG. 10 is substantially similar in construction to the fifth embodiment shown in FIG. 9 except that the positions of the auxiliary anodes and cathodes are reversed so that the cathodes cannot be viewed from the face plate 10. The mode of operation as well as the features and advantages of the sixth embodiment are substantially similar to those of the fifth embodiment.

Figure 11:
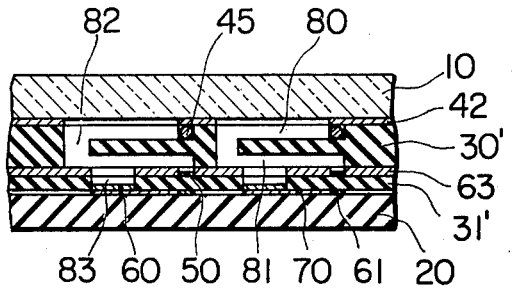
FIG. 11 is a sectional view of a seventh embodiment of the present invention.
Figure 12A:
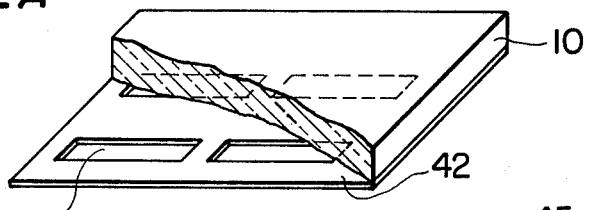
FIG. 12 is an exploded perspective view of a face plate, intermediate insulating plates and a base, respectively, of the embodiment of FIG. 11.
Figure 12B:
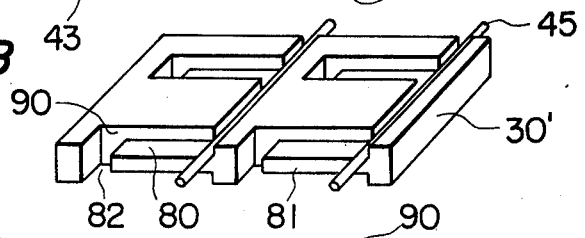
Figure 12C:
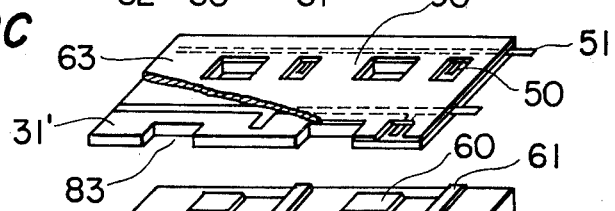
Figure 12D:
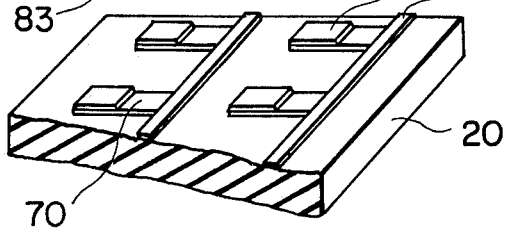

Seventh Embodiment: FIGS. 11 and 12

The seventh embodiment shown in FIGS. 11 and 12 is also substantially similar in construction to the fourth embodiment shown in FIGS. 7 and 8 except for the modifications to be described below.

The transparent insulating face plate 10 has its undersurface coated with a black dielectric layer 42, except for those areas in opposed relation with the main discharge space 80, so that the socalled black matrix effect can be obtained. That is, the black dielectric layer 42 is provided with a plurality of rectangular openings 43 through which are exposed the main discharge spaces 80.

The first intermediate thin insulating plate 30′ is similar to the plate 30 shown in FIG. 8 except that the anode 45 of wire is disposed in the groove formed in the upper surface of the plate 30′. The wire anode 45 also serves as an anode conductor. The walls of the main discharge space 80 are applied with the phosphor coatings 90.

The second thin insulating plate 31′ is provided with a plurality of openings 83 similar in size with the cathode 60. The auxiliary anodes 50 and the auxiliary anode conductors 51 are formed on the upper surface of the second insulating plate 31′ by the conventional printing method, and a short-circuit preventive dielectric layer 63 is interposed between the first and second thin insulating plates 30′ and 31′.

The dielectric layer 63 is provided with small openings so that the auxiliary anodes 50 may be exposed to the auxiliary discharge space 81. The area of the upper surface of the dielectric layer 62 immediately below each small hole or passage 85 between the main and auxiliary discharge spaces 80 and 81 is coated with the phosphor coating 90.

In the seventh embodiment, the auxiliary anodes 50 may be formed by sintering silver paste, and in this case, it is preferable to plate the surface of the auxiliary anode 50 with nickel.

The insulating base or substrate 20 includes the cathodes, resistors 70 and cathode conductors 61 as with the case of the fourth embodiment, and if required a dielectric layer may be applied over the upper surface of the base or substrate 20.

In addition to the features and advantages described above, the seventh embodiment has an advantage in that atoms and groups of atoms emitted from the cathode are prevented from scattering because the cathode 60 is exposed only to the opening 83 formed through the second thin insulating plate 31′ so that the service life thereof may be remarkably increased.

As described above, the present invention may provide a highly luminous and highly efficient flat discharge display panel which may be fabricated at less cost, and may have a memory function and in which there is utilized the positive columns because the main and auxiliary discharge spaces are disposed in parallel with the face plate.

What is claimed is:

1. In a flat discharge display panel of the type having a plurality of gas discharge cells arrayed in a matrix form, an improvement wherein each cell comprises:

a main anode electrode, and means for supporting said main anode electrode;

an auxiliary anode, and means for supporting said auxiliary anode;

a cathode electrode interposed between said main anode electrode and said auxiliary anode electrode and perpendicular to said main anode electrode, said auxiliary electrode being spaced apart from said main anode electrode and said cathode electrode by such a distance that a first positive column is produced between said main anode electrode and said cathode electrode and a second positive column is produced between said auxiliary anode electrode and said cathode electrode in parallel with said first positive column;

first means defining a main discharge space between said main anode electrode and said cathode electrode, said first positive column being produced in said main discharge space;

second means defining an auxiliary discharge space between said auxiliary anode electrode and said cathode electrode, said auxiliary discharge space being in communication with said main discharge space through a passage, said second positive column being produced in said auxiliary discharge space; and a resistor element connected to said cathode electrode, whereby when a DC voltage is applied between said anode electrode and said cathode electrode through said resistor element and between said auxiliary electrode and said cathode electrode through said resistor element and said DC voltage is varied, one of said first and second positive columns may be selectively produced and said first positive column thus produced may be used for display purposes.

2. A flat discharge display panel according to claim 1, wherein said first and second means are formed by an intermediate plate disposed between said respective supporting means for said main anode electrode and said auxiliary anode electrode, said intermediate plate including a first groove or recess in one surface thereof facing said main anode electrode forming said main discharge space and a second groove or recess in the The longer the main discharge space 80, the greater the value of the first term ($V_{Abd} - V_{Am}$) becomes, and the same is true for the second term ($V_{Sbd} - V_{Sm}$). In other words, the longer the length of the main and auxiliary discharge spaces 80 and 81, the greater the value of the memory margin becomes. These relations have been confirmed by the experiments conducted by the inventors.

Instead of the auxiliary anode 50 made of wire, conductors may be printed on the dielectric layer 62 between the base or substrate 20 and the intermediate thin insulating plate 30, and an additional dielectric layer may be interposed between the dielectric layer 62 and the intermediate thin insulating layer 30. When the dielectric layer 42 made of a dielectric material having a color is used, an opening is formed to expose the main discharge space 80. When the intermediate thin insulating plate 30 is made of colored glass or the like, the effect similar to the black matrix of a color television kinescope may be attained with the result in the improvement of the quality of the image displayed.

Figure 3:
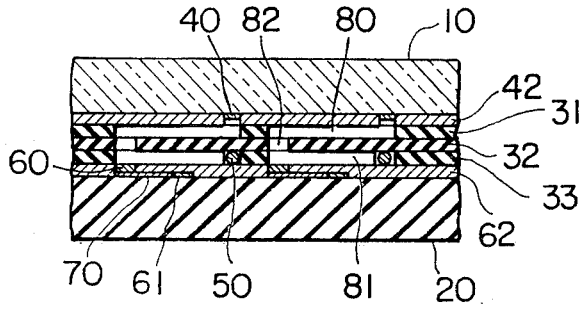
FIG. 3 is a schematic sectional view of a second embodiment of the present invention.
Figure 4A:
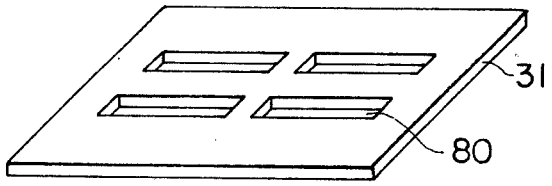
FIG. 4 is an exploded perspective view of first, second, and third intermediate insulating plates respectively, of the embodiment of FIG. 1.
Figure 4B:
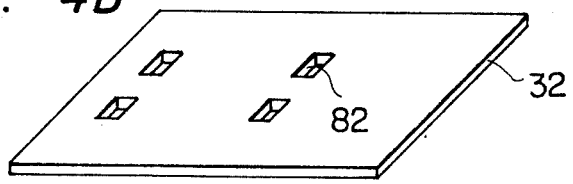
Figure 4C:
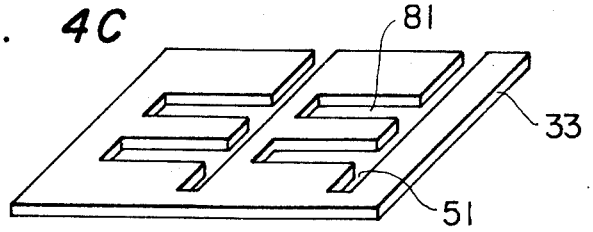

Second Embodiment: FIGS. 3 and 4

In FIGS. 3 and 4 there is shown a second embodiment of the present invention which is substantially similar in construction to the first embodiment except that instead of the single intermediate thin insulating plate 30, three thin insulating plates 31, 32 and 33 are overlaid on each other and interposed between the face plate 10 and the base or substrate 20.

The first insulating plate 31 is provided with a plurality of rectangular openings 80 each of which defines the main discharge space 80, and the second insulating plate 32 is provided with a plurality of small holes or passages 82 each of which intercommunicates between the main discharge space 80 and the auxiliary discharge space 81 formed in the third plate 33, which is further provided with a recess 51 for receiving therein the auxiliary anode 50.

One of the advantages of this second embodiment resides in the fact that because three insulating plates are used, their thickness may be reduced (for instance, to 0.2 mm) and the formation of the main and auxiliary discharge spaces and the passages therebetween, as well as the assembly thereof, may be much facilitated.

Figure 5:
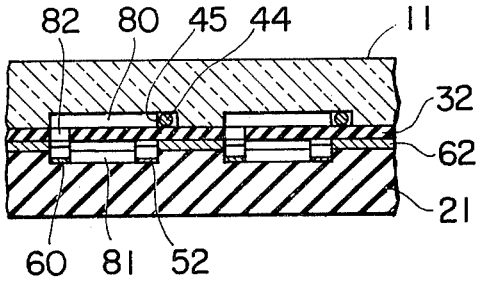
FIG. 5 is a schematic sectional view of a third embodiment of the present invention.
Figure 6:
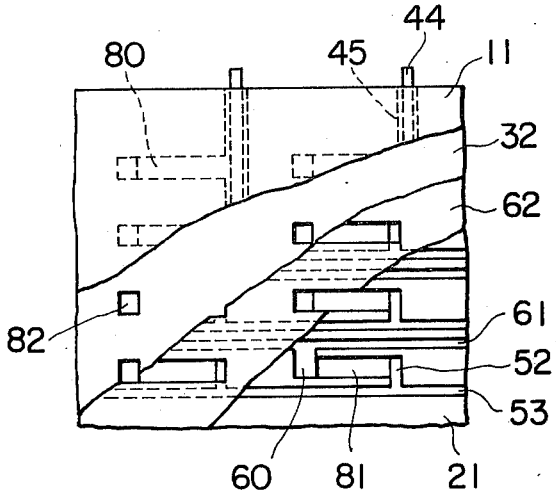
FIG. 6 is a top view, partly broken, of the embodiment of FIG. 5.

Third Embodiment: FIGS. 5 and 6

The third embodiment of the present invention shown in FIGS. 5 and 6 is substantially similar in construction to the second embodiment described above with reference to FIGS. 3 and 4 except that only one insulating plate, i.e., the second insulating plate 32, is used. Therefore, the main discharge spaces 80 are formed in the face plate while the auxiliary discharge spaces 81 are formed in the insulating base or substrate.

More particularly, the face plate 11 is formed with the main discharge spaces 80 and the grooves 45 for receiving therein the anodes 44. These spaces and grooves may be formed, for instance, by conventional photoetching techniques. In like manner, the base or substrate 21 is provided with the auxiliary spaces 81, and an auxiliary anode 52 is disposed at one side of each auxiliary discharge space 81 while a cathode 60 is disposed on the other side in such a way that conductors 53 and 61 to these auxiliary anodes and cathodes extend at right angles relative to the anodes 44. The dielectric layer 62 is interposed between the base or substrate 21 and the intermediate thin insulating plate 32.

It is to be understood that in addition to the first, second and third embodiments described above, various modifications may be effected. For instance, the discharge space may be provided as a bent or spiral structure, and the cathode 60 may be placed at any desired position so long as it is in line with the small hole or passage 82 interconnecting the main and auxiliary discharge spaces. Furthermore, the dimensions of the cathode may be arbitrarily selected depending upon the discharge current used.

So far the cathode 60 has been described as being placed below or in line with the small hole or passage 82, but it may be placed otherwise and part of the auxiliary discharge cell which may be coated with a suitable phosphor may be used as a passage for the main discharge so that highly luminous and efficient flat display units may be provided.

Fourth Embodiment: FIGS. 7 and 8

Figure 7:
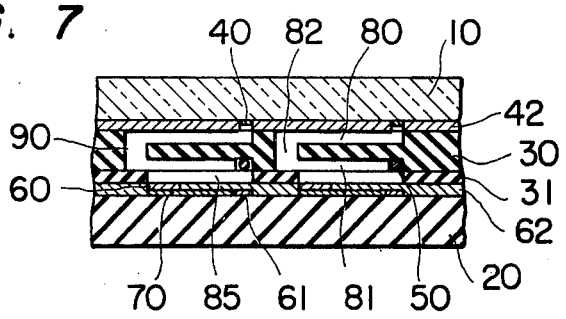
FIG. 7 is a schematic sectional view of a fourth embodiment of the present invention.
Figure 8A:
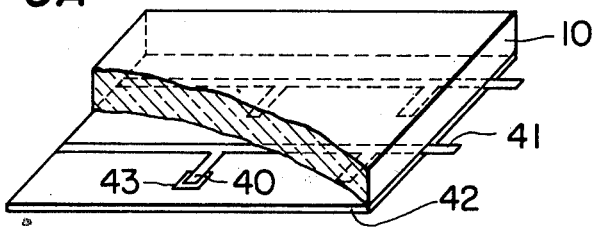
FIG. 8 is an exploded perspective view of a face plate, intermediate insulating plates and a base, respectively, of the embodiment of FIG. 7.
Figure 8B:
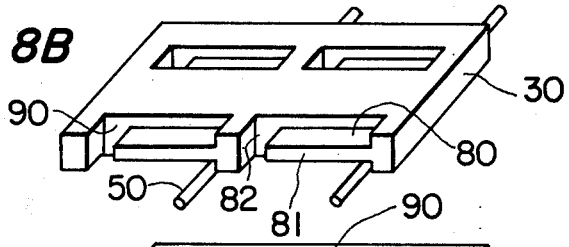
Figure 8C:
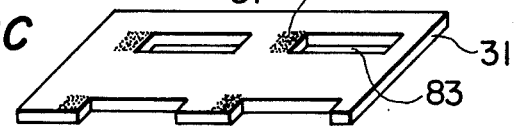
Figure 8D:
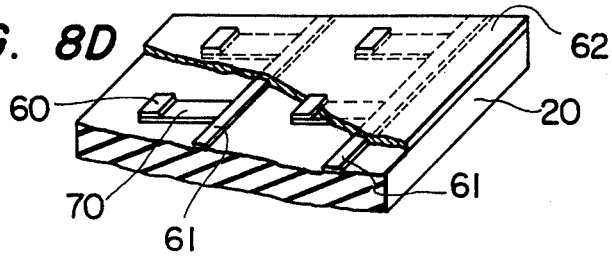

The fourth embodiment shown in FIGS. 7 and 8 is substantially similar in construction to the first embodiment shown in FIGS. 1 and 2 except that the first thin insulating plate 31 of the second embodiment shown in FIGS. 3 and 4 is interposed between the insulating plate 30 and the base or substrate 20.

Furthermore, each main discharge space 80 has its side walls, bottom and top, that is, the portion of the under-surface of the face plate 10 defining each main discharge space 80 is coated with a phosphor 90. Alternatively, a partial phosphor coating may be applied. The portion of the upper surface of the insulating plate 31 immediately below the small hole or passage 85 intercommunicating the main and auxiliary discharge spaces 80 and 81 is also applied with the phosphor coating 90. Therefore, the fourth embodiment has a distinct advantage in that part of the auxiliary discharge space, as well as the small hole or passage 85, may be used as a main discharge passage to that the effective light emitting area may be increased with the result that high luminosity and the positive column may be also increased to provide high luminous efficiency.

Another advantage of the fourth embodiment is that the auxiliary discharge space 81 may be increased in volume because it is defined by the recess 81 of the insulating plate 30 and the recess 83 of the insulating plate 31 so that the discharge voltage may be decreased.

In the fourth embodiment it should be noted that the cathode 60 formed at one end of the resistor 70 in the manner described above is positioned not immediately below the small hole or passage 85 between the main and auxiliary discharge spaces 80 and 81. In other words, the cathode 60 is placed in such a position that when one views the face plate, one cannot see the cathode 60 through the small hole or passage 85.

So far the resistors 70 for memory drive have been incorporated in the flat discharge display panels of the first through fourth embodiments, but it will be understood that these resistors 70 may be eliminated so that sequential line scanning may be effected.

In addition to the preferred embodiments described above, various modifications may be effected. For instance, the arrangement of the anodes, auxiliary discharge anodes and cathodes is not limited to that described above with reference to the accompanying drawings. They may be freely arrayed as far as they form a desired matrix for display.

other surface thereof facing said auxiliary anode electrode forming said auxiliary discharge space, said first and second grooves or recesses being elongated and disposed in parallel one on top of the other between said main anode and auxiliary anode electrodes and being interconnected by a through hole.

3. A flat discharge display panel according to claim 2 wherein said intermediate plate is formed of three layers, a first layer having an aperture forming said first groove or recess, a second layer having an aperture forming said through hole, and a third layer having an aperture forming said second groove or recess.

4. A flat discharge display panel according to claim 2 wherein the walls of said main discharge space are coated with a phosphor.

5. A flat discharge display panel according to claim 4 wherein a portion of said auxiliary discharge space in alignment with said through hole is coated with a phosphor.

6. A flat discharge display panel according to claim 1 wherein said auxiliary anode electrode is disposed in said auxiliary discharge chamber.

7. A flat discharge display panel according to claim 1 wherein said main anode electrode is disposed in said main discharge chamber.

8. A flat discharge display panel comprising a. a transparent, insulating face plate;

b. a base or substrate made of an electrically insulating material;

c. an intermediate insulating plate interposed between said transparent, insulating face plate and said base or substrate;

d. means defining a plurality of main discharge spaces between said transparent, insulating face plate and one major surface of said intermediate insulating plate, each of said main discharge spaces being elongated in shape, said main discharge spaces being arrayed in column and row in such a way that they are in parallel with each other in their longitudinal direction;

e. a plurality of main anode electrodes each disposed in said main discharge spaces in parallel with each other, f. means defining a plurality of auxiliary discharge spaces between said base or substrate and the other major surface of said intermediate insulating plate, each of said auxiliary discharge spaces being elongated in shape, said auxiliary discharge spaces being arrayed in column and row in such a way that they are in parallel with each other in their longitudinal direction;

g. a plurality of auxiliary anode electrodes each disposed in respective auxiliary discharge spaces in parallel with each other and parallel to said anode electrode;

h. a plurality of connecting holes formed through said intermediate insulating plate for interconnecting the adjacent main and auxiliary discharge spaces;

i. a plurality of cathode electrodes disposed on one of the major surfaces of said base or substrate on the side thereof facing said intermediate insulating plate, each of said cathode electrodes being disposed adjacent to a respective connecting hole, a positive column being produced between the cathode electrode and the adjacent auxiliary anode electrode when excited; and j. discharge gas filled in each of the adjacent interconnected main and auxiliary discharge spaces, whereby the positive columns produced between the paired main anode electrode and cathode electrode and between the paired auxiliary anode electrode and cathode electrode are formed in parallel with said transparent, insulating face plate.

9. A flat discharge display panel according to claim 8 wherein said intermediate insulating plate is formed of three layers, the first layer including said main discharge spaces, the second layer including said connecting holes, and the third layer including said auxiliary discharge spaces.

10. A flat discharge display panel according to claim 8 wherein the walls of said main discharge spaces are coated with a phosphor.

11. A flat discharge display panel according to claim 10 wherein a portion of said auxiliary discharge spaces in alignment with said connecting holes is coated with a phosphor.

12. A flat discharge display panel according to claim 8 wherein the surface of said face plate facing said intermediate insulating plate is covered with a black coating except for those areas in opposed relation with said main discharge spaces.

13. A flat discharge display panel comprising a. a transparent, insulating face plate;

b. a base or substrate made of an electrically insulating material;

c. an intermediate insulating plate interposed between said transparent, insulating face plate and said base or substrate and in contact therewith;

d. a plurality of first elongated recesses or grooves formed in the major surface of said intermediate insulating plate which is in contact with said transparent, insulating face plate;

e. a plurality of second elongated recesses or grooves formed in the major surface of said intermediate insulating plate which is in contact with said base or substrate;

f. said first and second recesses or grooves being arrayed in column and row in such a way that they form pairs which are in parallel with each other in their longitudinal direction, g. a plurality of through holes formed through said intermediate insulating plate for interconnecting the paired first and second recesses or grooves;

h. a plurality of main anode electrodes arrayed in parallel with each other on one of the major surfaces of said transparent, insulating face plate in contact with said one major surface of said intermediate insulating plate, each of said main anode electrodes being disposed in each of said first recesses or grooves at a position remote from said through holes;

i. a plurality of auxiliary anode electrodes arrayed in parallel with each other on the other major surface of said intermediate insulating plate, each of said auxiliary anode electrodes being disposed in respective second elongated recesses or grooves at one side thereof remote from said through hole;

j. a plurality of cathode electrodes arrayed on one of the major surfaces in contact with said the other major surface of said intermediate insulating plate of said base or substrate, each of said cathode electrodes being disposed adjacent to each of said through holes; and k. discharge gas filled in each of the paired first and second elongated recesses or grooves, whereby a positive column produced between the paired anode electrode and cathode electrode in each of said first elongated recesses or grooves as well as a positive column produced between the paired auxiliary anode electrode and cathode electrode in each of said second elongated recesses or grooves are formed in parallel with said transparent, insulating face plate.

14. A flat discharge display panel comprising:

a. a transparent, insulating face plate;

b. a base or substrate made of an electrically insulating material;

c. an intermediate insulating plate interposed between said transparent, insulating face plate and said base or substrate;

d. a plurality of first elongated recesses or grooves formed in one of the major surfaces of said intermediate insulating plate in contact with said transparent, insulating face plate, e. a plurality of second elongated recesses or grooves formed in the other major surface of said intermediate insulating plate, f. each of said first and second elongated recesses or grooves being arrayed in row and column in such a way that they form pairs which are in parallel with each other in their longitudinal direction;

g. a plurality of through holes formed through said intermediate insulating plate for interconnecting the paired first and second elongated recesses or grooves;

h. a plurality of main anode electrodes arrayed in parallel with each other on one of the major surfaces of said transparent, insulating face plate in contact with said one major surface of said intermediate insulating plate, each of said main anode electrodes being disposed in each of said first elongated recesses or grooves adjacent to one side thereof remote from said through hole;

i. a plurality of auxiliary anode electrodes arrayed in parallel with each other and parallel to said main anode electrodes on the other major surface of said intermediate insulating plate, each of said auxiliary anode electrodes being disposed in each of said second elongated recesses or grooves;

j. a plurality of cathode electrodes arrayed on one of the major surfaces of said base or substrate in contact with said intermediate insulating plate, each of said cathode electrodes being disposed in each of said second elongated recesses or grooves adjacent to one side thereof remote from said through hole; and k. discharge gas filled in each of the paired first and second elongated recesses or grooves, whereby a positive column produced between the paired main anode electrode and cathode electrode in each of said first elongated recesses or grooves as well as a positive column produced between the paired auxiliary anode electrode and cathode electrode in each of said second elongated recesses or grooves are in parallel with said transparent, insulating face plate.

* * * * *